US011149435B1

(12) United States Patent
Sayeri

(10) Patent No.: US 11,149,435 B1
(45) Date of Patent: Oct. 19, 2021

(54) METHOD AND APPARATUS FOR PROTECTING STRUCTURES AGAINST FIRES IN HIGH WIND CONDITIONS

(71) Applicant: EVAC FIRE PREVENTION, LLC, Canoga Park, CA (US)

(72) Inventor: Matt Sayeri, West Hills, CA (US)

(73) Assignee: EVAC FIRE PREVENTION, LLC, Canoga Park, CA (US)

( * ) Notice: Subject to any disclaimer, the term of this patent is extended or adjusted under 35 U.S.C. 154(b) by 0 days.

(21) Appl. No.: 17/200,769

(22) Filed: Mar. 13, 2021

Related U.S. Application Data

(63) Continuation of application No. 63/063,710, filed on Aug. 10, 2020.

(51) Int. Cl.

| | |
|---|---|
| ***A62C 2/08*** | (2006.01) |
| ***E04D 1/30*** | (2006.01) |
| ***A62C 3/02*** | (2006.01) |
| ***A62C 35/60*** | (2006.01) |
| ***A62C 35/68*** | (2006.01) |
| ***A62C 35/02*** | (2006.01) |

(52) U.S. Cl.
CPC ..... *E04D 1/30* (2013.01); *A62C 2/08* (2013.01); *A62C 3/0214* (2013.01); *A62C 35/02* (2013.01); *A62C 35/60* (2013.01); *A62C 35/68* (2013.01); *E04D 2001/308* (2013.01)

(58) Field of Classification Search
CPC ..... E04D 1/30; E04D 2001/308; E04D 2013/0853; E04D 2013/0427; E04D 13/0645; A62C 2/08; A62C 3/0214; A62C 35/02; A62C 35/60; B05B 14/465; B05B 17/085; E03B 3/02; E03B 3/40
See application file for complete search history.

(56) References Cited

U.S. PATENT DOCUMENTS

| | | | | | |
|---|---|---|---|---|---|
| 1,644,603 | A * | 10/1927 | O'Neill | A62C 99/0027 | 169/16 |
| 3,583,490 | A * | 6/1971 | McFadden | A62C 3/00 | 169/60 |
| 5,537,696 | A * | 7/1996 | Chartier | B05B 1/044 | 4/507 |
| 2010/0263295 | A1* | 10/2010 | Flanagan | E04D 13/08 | 52/1 |

* cited by examiner

*Primary Examiner* — Tuongminh N Pham

(57) ABSTRACT

Certain aspects relate to an apparatus for fire protection to a peak of a roof of a structure including a fire-retardant conduit mounted to the peak of the roof. The fire-retardant conduit includes a channel having sidewalls, each sidewall including a top portion having a lip; a channel windbreak configured to cover the channel and the lip of the channel; and a fire-retardant source pipe coupling the fire-retardant conduit to a fire-retardant source to supply fire-retardant into the channel.

12 Claims, 11 Drawing Sheets

METHOD AND APPARATUS FOR PROTECTING STRUCTURES AGAINST FIRES IN HIGH WIND CONDITIONS

CROSS-REFERENCE TO RELATED APPLICATIONS

This application claims priority to and the benefit of provisional patent application No. 63/063,710 filed in the United States Patent and Trademark Office on Aug. 10, 2020, the entire content of which is incorporated herein by reference.

BACKGROUND

Field

The present disclosure generally relates to fire protection systems, and more particularly, to a method and apparatus for protecting structures against fires in high wind conditions capable of wetting the exterior of a building in high-wind conditions to prevent combustion of the building from a fire near the building.

Background

The numerous occurrences of recent fires throughout the world have highlighted the need for improved fire protection. Structures located in certain geographic areas are subject to high risk of fires, whether that is due to climate change or other environmental effects, such as droughts or natural occurrences of fires, such as in heavily wooded areas. In addition, fires due to arson or other human causes can exacerbate the issue.

Some existing fire protection systems operate by spraying water on the rooftops of the building structure, such as single-family dwellings that have sloped roofs. The main purpose of these fire protection systems is to protect the building from flaming debris from igniting the building structure. The flaming debris can come from fires that are next to the building structure, such as from a forest fire or fire from another building structure. However, these systems prove to be ineffective when there are high wind conditions, such as due to a phenomenon referred to as a firestorm when the intense heat from a large fire causes significant air movement that may reach several tens of miles per hour. Thus, the water that is meant to protect the roof is instead blown away by the wind generated by the firestorm—leaving the rooftop exposed and subject to ignition by flaming debris.

It would therefore be greatly advantageous to provide protection against fires that will be effective in all types of wind conditions, including wind conditions that would normally render other approaches ineffective.

SUMMARY

The systems, methods, apparatuses, and devices of the disclosure each have several aspects. No single one of the aspects is solely responsible for desirable attributes of such systems, methods, apparatuses, and devices. Without limiting the scope of this disclosure as expressed by the claims which follow, some aspects will now be discussed briefly. After considering this discussion, and particularly after reading the section entitled "Detailed Description" one will understand how the aspects of this disclosure provide advantages that include improved protection for rooftops against embers or other flaming debris from a nearby fire under various wind conditions, including high wind conditions.

The following presents a simplified summary of one or more aspects of the disclosed approach for a method and apparatus for protecting structures against fires in high wind conditions, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Instead, its sole purpose is to present some concepts of one or more aspects of the disclosure in a simplified form as a prelude to the more detailed description that is presented later herein.

The present invention provides an improved fire protection system. In accordance with one aspect of the invention, a fire-retardant distribution system of the fire protection system includes features to ensure that, regardless of the surrounding environmental conditions, a fire-retardant substance such as water is discharged onto the roof of a structure along its peak or crest and flows by gravity along the roof to the eaves, then around the underside of the eaves to the walls, and finally downwardly along the walls. Thus, both the roof and walls are wetted with a water discharging mechanism that is economical to manufacture and easy to install. One element of this water discharging mechanism is a unique water channel structure. According to an important feature of this inventive aspect, a protective cover is provided along a water channel, configured to cover the water channel while simultaneously acting as a windbreak.

Another aspect of the invention is concerned with the configuration of the water distribution system in such a way that multiple roof tops may be simultaneously protected. Specifically, the water distribution system includes an interconnection mechanism for connecting multiple water channels that, for example, connects a first water channel of the water distribution system to a second water channel of the water distribution system to simultaneously supply water to the first water channel while also supplying water to a second water channel. The water distribution system may be supported by a pump that is operated by a control unit. The control unit may be configured to operate based on information received from one or more sensors. These sensors may be placed at selected locations on and/or about the building structure to be protected. Actuation of the control unit to start the water distribution system may be by detection of a fire by any of the sensors.

Aspects generally include methods, apparatuses, and systems, as substantially described herein with reference to and as illustrated by the accompanying drawings. Numerous other aspects are provided.

To the accomplishment of the foregoing and related ends, the one or more aspects include the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

These and other aspects of the invention will become more fully understood upon a review of the detailed description, which follows.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

To facilitate understanding, identical reference numerals have been used, where possible, to designate identical elements that are common to the figures. It is contemplated that elements disclosed in one aspect may be beneficially used on other aspects without specific recitation.

DETAILED DESCRIPTION

Figure 1:
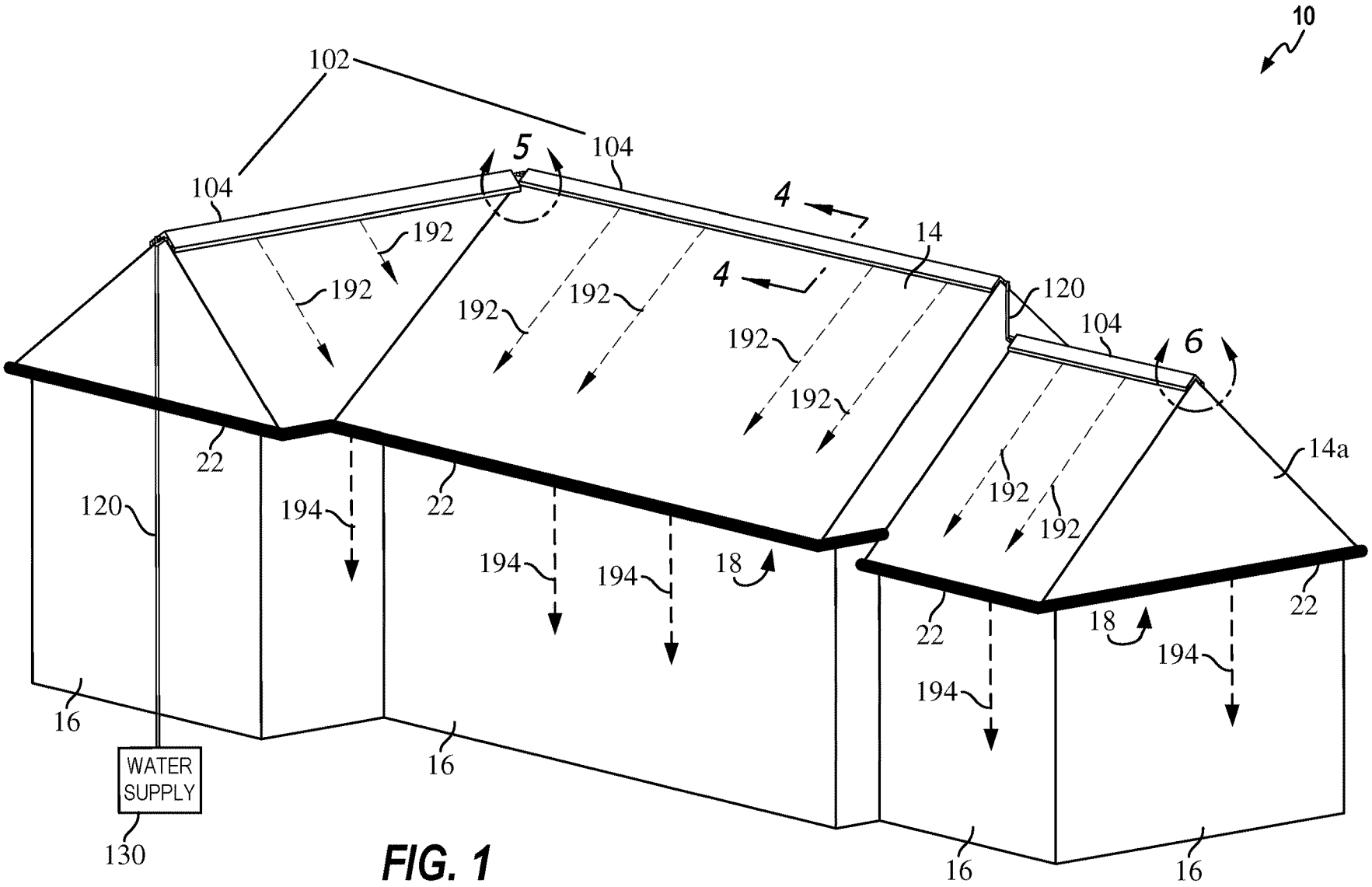
FIG. 1 is a perspective view of a building structure equipped with a water distribution for a fire protection system configured in accordance with certain aspects of the present disclosure for a method and apparatus for protecting structures against fires in high wind conditions.
Figure 2:
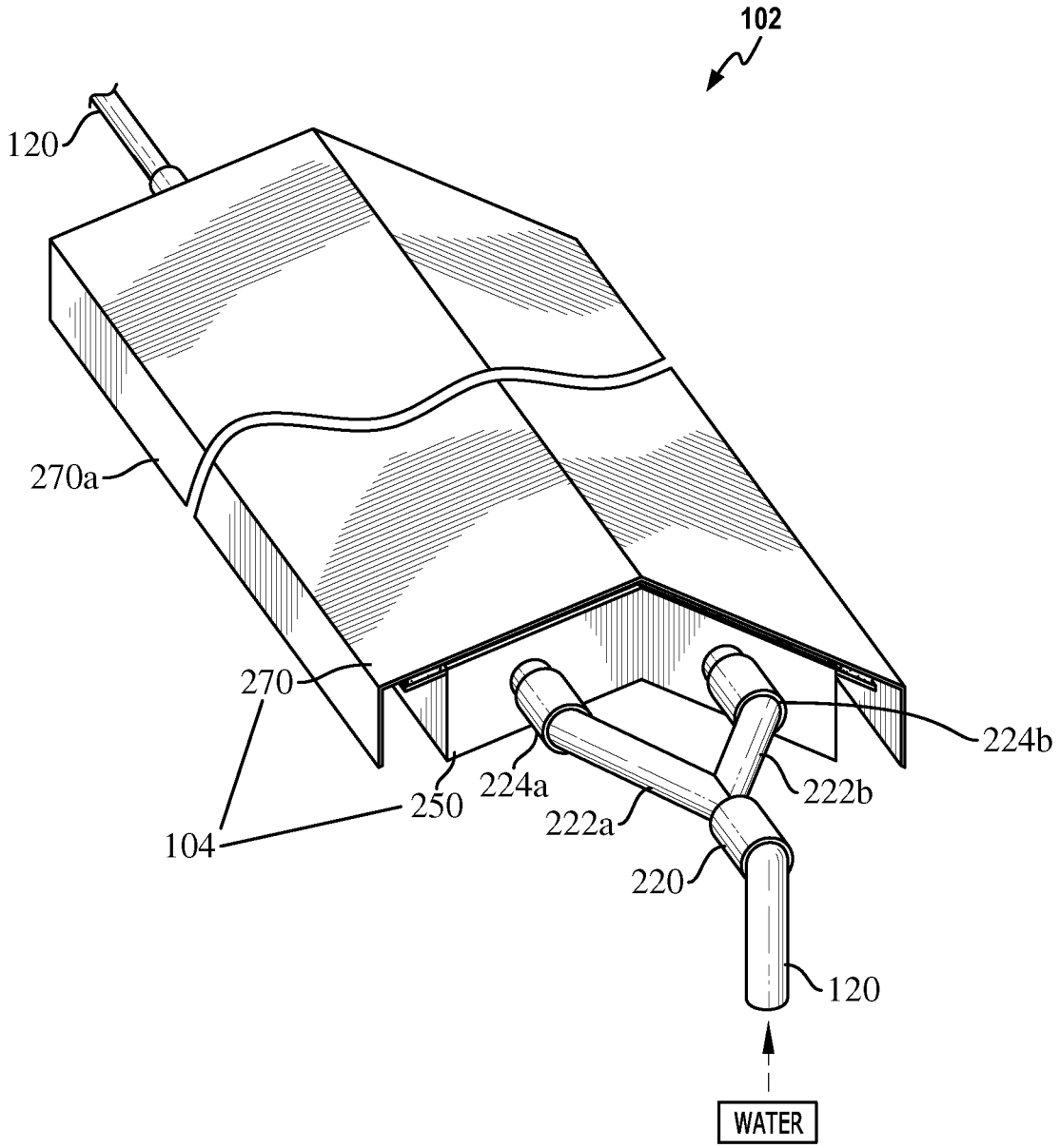
FIG. 2 is a perspective view of an exterior of an interconnection mechanism for connecting multiple water channels in the fire protection system configured in accordance with certain aspects of the present disclosure.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects. Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to a variety of structures, some of which are illustrated by way of example in the figures and in the following description of the preferred aspects. The detailed description and drawings are merely illustrative of the disclosure rather than limiting, the scope of the disclosure being defined by the appended claims and equivalents thereof.

The following description is directed to certain implementations for the purposes of describing the innovative aspects of this disclosure. However, a person having ordinary skill in the art will readily recognize that the teachings herein can be applied in different ways and may be incorporated into various types of communication networks or network components. In some aspects, the teachings herein may be employed in a fire protection system capable of operating in high wind conditions.

The techniques may be incorporated into (such as implemented within or performed by) a variety of water distribution systems. In some implementations, the water distribution system of the fire protection system only needs to provide water for one roof. In some other implementations, the water distribution system of the fire protection system needs to provide water for multiple roofs. In still some other implementations, the water distribution of the fire protection system may provide water for multiple, non-adjoining roofs.

The following terms may be used to describe and reference the parts of a structure that may be protected by the fire protection system:

- Roof plane: The surface of the roof, which is flat, but pitched or on an angle. It may also be referenced herein as the "field" of the roof.
- Ridge: The top or peak of the roof where two roof planes meet.
- Valley: Where two pitched roof faces connect and project inward. They are always at a lower slope than the adjoining roof planes.
- Dormer: A roof feature that projects out from the roof face that usually houses a window and adds extra space and/or light to the room inside.
- Abutment: The spot where the roof face meets the wall of the home, instead of a roof ridge.
- Hip: Where two roof faces connect and project outward.
- Gable: A triangular wall underneath where two roof planes meet.
- Gable end: The gable end of the roof is the edge of a roof above the gable.
- Hipped end: The hipped end of the roof is the sloped roof face between two roof hips. For example, a pyramid roof has four hipped ends. As another example, a hipped roof has only two hipped ends.
- Eave: Where the roof hangs over the edge of the exterior wall.

It should be noted that although the term "conduit" is used throughout the specification to refer to a structure for distributing and deploying firefighting material, those of ordinary skill in the art would understand that other terms may be used. By way of example and not limitation, these other terms may include terms such as: passageway, channel, duct, pipe, tube, gutter, groove, furrow, trough, trench, culvert, cut, sluice, spillway, race, flume, chute, ditch, or drain. Thus, the term "conduit" and its equivalents should not be interpreted nor limited in a manner contrary to how the term is used herein.

Moreover, the term "fire-retardant" as used herein may refer to any substance that can be used to slow down or stop the spread of fire, and/or reduce its intensity. Thus, a fire-retardant may operate by initiating chemical reactions that reduce the flammability of materials or delay their combustion. A fire-retardant may also cool materials through physical action or endothermic chemical reactions. For example, water is usually the first substance that many people think of as a "fire-retardant" and is used as an example herein to describe the various inventive aspects of the method and apparatus for protecting structures against fires in high wind conditions. However, fire-retardants may also refer to substances that may be mixed with water to create a foam or gel.

Turning now to the drawings, in FIG. 1, a building structure 10 is illustrated that, in this instance, is a residential structure. The building structure 10 has a (peaked/sloping) roof 14 and sidewalls 16. Edges of the roof 14 project beyond the sidewalls 16 to form multiple overhanging eaves 18.

The building structure 10 may be equipped with a fire protection system 100 configured in accordance with various aspect of the current disclosure. In general terms, the fire protection system 100 includes a water distribution system 102 mounted along a peak (crest) of the roof 14. The water distribution system 102 include multiple conduits 104 configured to dispense water onto the roof 14 from each crest, as further detailed herein. Once dispensed, the water flows by gravity, downwardly following the contours of the roof 14, as illustrated by arrows 192. For sake of clarity and to minimize potential clutter in the figures, only a limited number of the arrows 192 are illustrated. Those skilled in the art will understand the roof 14 will be sufficiently covered by the water dispensed by the conduits 104 and the fire protection system 100.

In accordance with one aspect of the current disclosure, the fire protection system may include a gutter system with a number of gutters 22 (gutter structures) mounted along the eaves 18 of the roof 14. The gutters 22 may include outlets for discharging water under the eaves 18 onto upper portions of the sidewalls 16. The water thus flows by gravity downwardly along the sidewalls 16, as illustrated by arrows 194. For sake of clarity and to minimize potential clutter in the figures, only a limited number of the arrows 194 are illustrated. Those skilled in the art will understand the sidewalls 16 will be sufficiently covered by the water dispensed by the gutters 22 and the fire protection system 102.

Also included in the fire protection system 100 is a water supply 130 for providing water to the water distribution system 102. Water from the water supply 130 may flow through one or more pipes 120. A pump (not shown), which may be operated by a motor, can be connected to the water source 130 for pumping water from the reservoir to supply the water distribution system 102. In accordance with various aspects of the present invention, water in the water supply 130 may be from a public source, such as a municipal water company. In addition, water for the water supply 130 may further or alternatively be sourced from a water reservoir such as a well, a swimming pool (not shown), or even recycled through a gutter/drain system that allows water already dispensed by the water distribution system 102 to be recaptured and reused. For example, the fire protection system 100 may also include a trough system with troughs mounted along each base of the sidewalls 16 for collecting the water draining from the sidewalls 16.

FIGS. 2-5 illustrate more details for the water distribution system 102, where one of the conduits 104 that is illustrated includes a channel 250 and a channel windbreak 270. As noted in the description associated with FIG. 1, the conduit 104 is supplied with water with the pipes 120. In one aspect of the disclosed approach, as detailed in FIGS. 2-3, and 5, the pipe 120 is coupled to a Y-joint 222 with a collar 220. The Y-joint 222 includes a first portion **222*a* and a second portion 222*b*. The first portion 222*a* is coupled to a bypass inlet 226*a* with a collar 224*a*, while the second portion 222*b* is coupled to supply water to the channel 250 through a supply inlet 226*b* with a collar 224*b*. Use of a mechanism like the Y-joint 222 allows water to be supplied to all the conduits 104 almost simultaneously, especially if there is sufficient water pressure. Although the Y-joint 222** is illustrated with two portions, a splitter that may have more than two portions may be used.

Those skilled in the art will understand that various fittings and materials may be used to implement and interconnect the pipes 120, the Y-joint 222, the collar 220, bypass inlet **226*a*, the collar 224*a*, the supply inlet 226*b*, and the collar 224*b***. For example, PVC materials may be used, and the fittings may be attached using adhesives. As another example, compression fittings may be used. Brass or other corrosion-resistant material may also be used. Thus, a combination of one or more approaches and different materials may be used.

Figure 3:
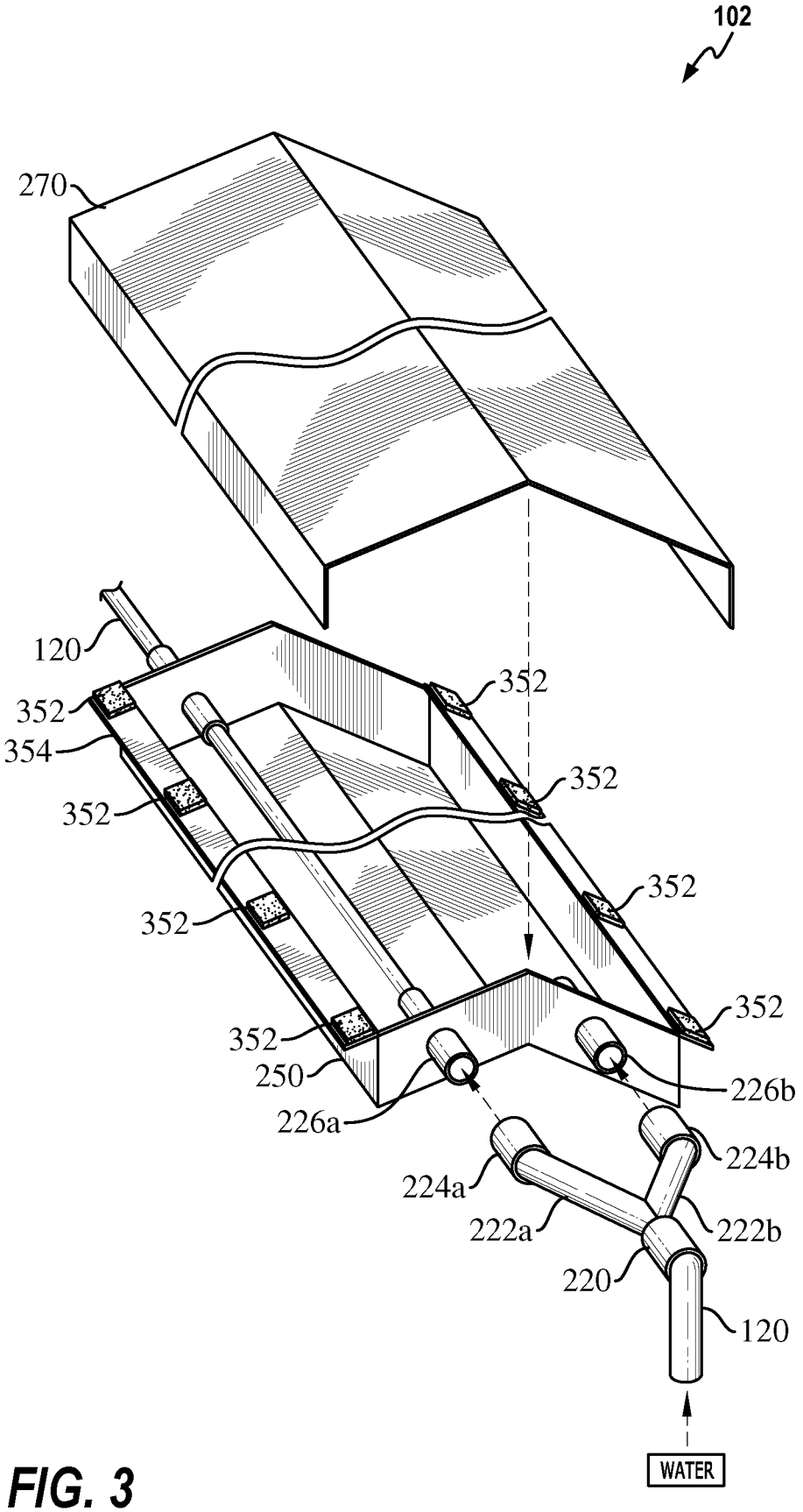
FIG. 3 illustrates an exploded perspective view of the interconnection mechanism of FIG. 2.

In FIG. 3, the channel windbreak 270 may be spaced separately from the channel 250 with a set of spacers 352. The set of spacers 352 may also include adhesives to secure the channel windbreak 270 to the channel 250. The channel windbreak 270 and the channel 250 may also be secured to each other through mechanical fasteners, such as rivets, screws, or nuts and bolts. Those skilled in the art would know the channel windbreak 270 may be spaced from the channel 250 in any suitable fashion. The channel windbreak 270 may also be secured to the channel 250 in any suitable fashion. For example, if a mechanical fastener such as a nut-and-bolt assembly is used, a cylindrical spacer through which the bolt passes-through may be used. Similarly, although it is not shown, the channel 250 may be secured to the roof 14 in a variety of fashions.

Figure 4:
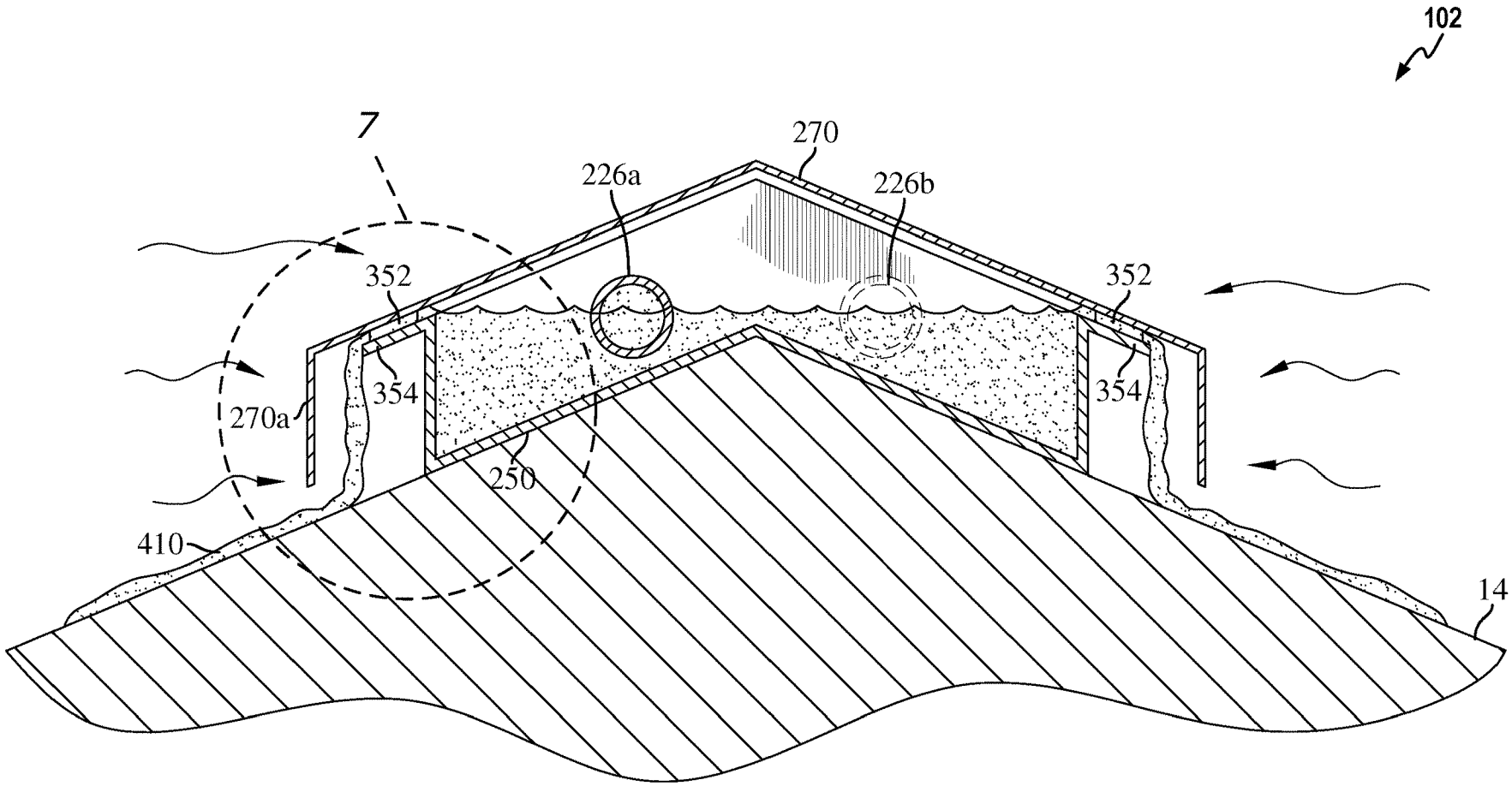
FIG. 4 illustrates an enlarged cross-sectional view taken on line 4-4 of FIG. 1.
Figure 5:
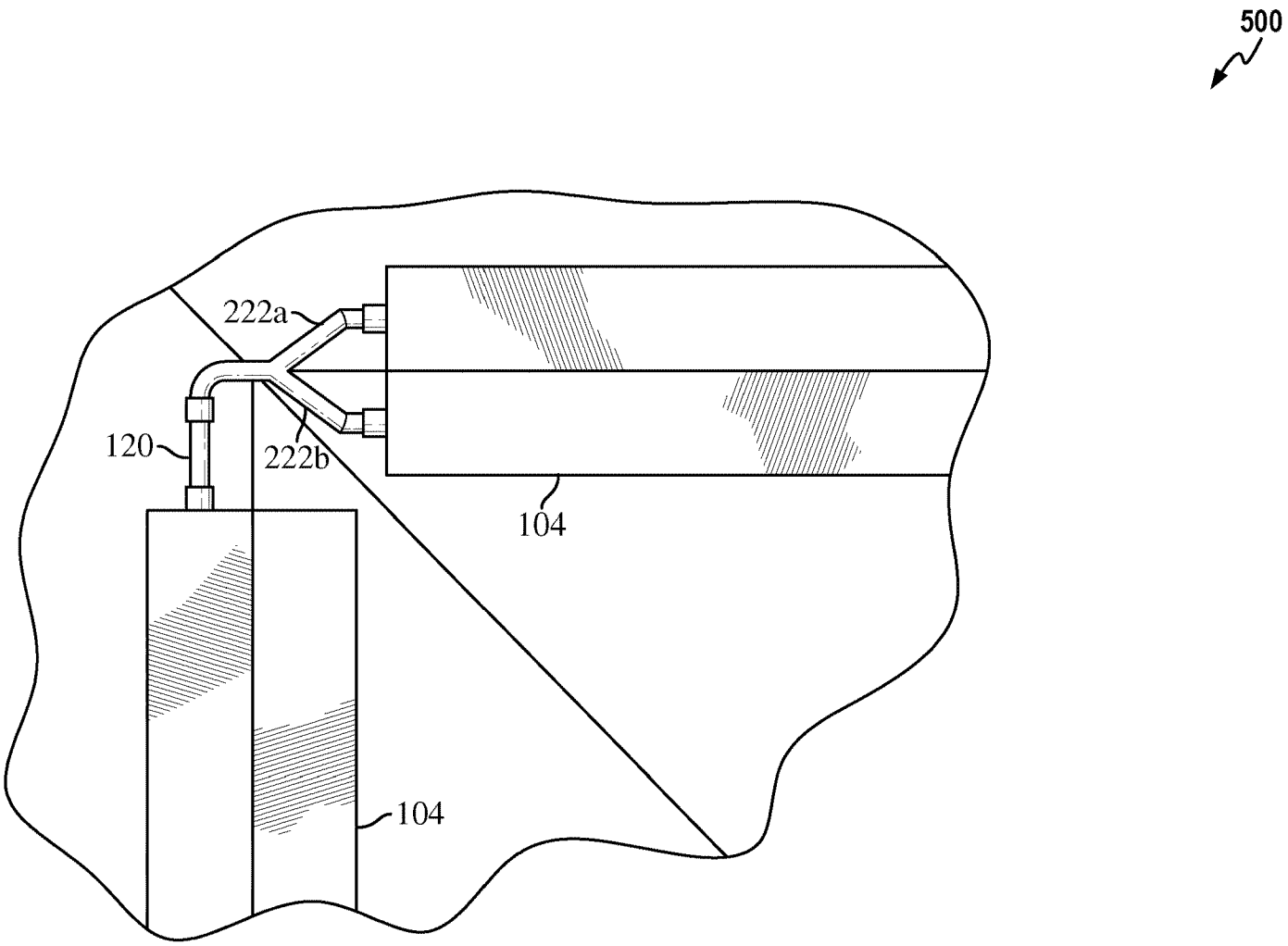
FIG. 5 illustrates an enlarged detail view taken on line 5-5 of FIG. 1.
Figure 7:
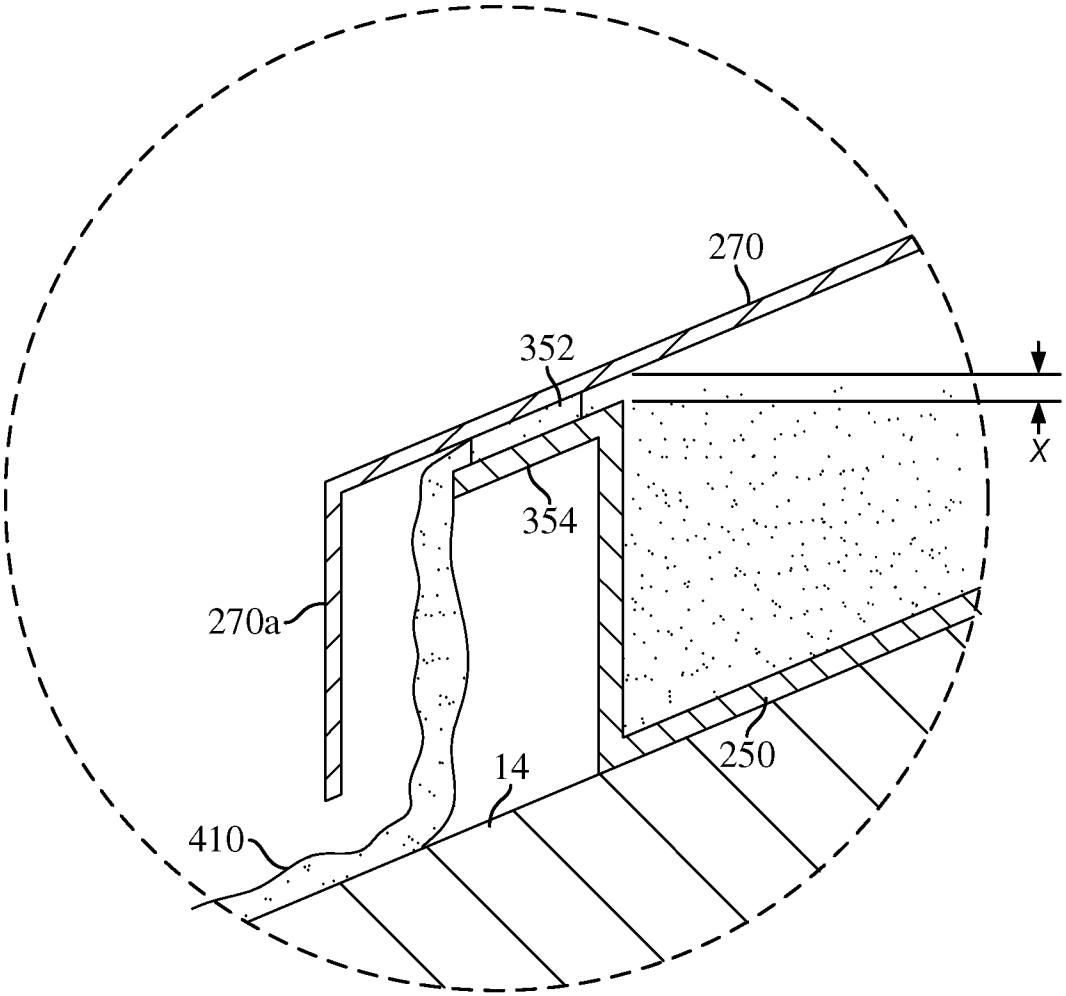
FIG. 7 illustrates a detail to point out a dimension for FIG. 4.

FIG. 4 illustrates how the channel windbreak 270 operates to allow water 410 from the channel 250 to be dispensed and flow onto the roof 14 even when there is a high amount of wind blowing against the conduits 104. The channel windbreak 270 includes an overhang portion **270*a* that overhangs an outside portion of the channel 250. In addition, the channel 250 includes a lip portion 354 that is covered by the channel windbreak 270. The overhang portion 270*a* is configured to significantly reduce the amount of wind that reaches the channel 250. The lip portion 354 allows the water 410 to flow over the channel 250 while already protected by the channel windbreak 270 and the overhang portion 270*a* of the channel windbreak 270. The amount of the water 410 dispensable by the conduits 104 may be controlled both by making the spacers 352 thinner or thicker, thereby controlling a spacing X between the channel windbreak 270 and the channel 250. The spacing X is shown in a detailed close-up in FIG. 7. The amount of water 410** dispensable by the conduits 104 may also be controlled by an amount of spacing between the overhang portion 270*a* and the roof 14. The lip portion 354 of the channel 250 is illustrated to be parallel to the channel windbreak 270, but in other embodiments the lip portion 354 may be configured differently with respect to the channel windbreak 270.

Figure 6:
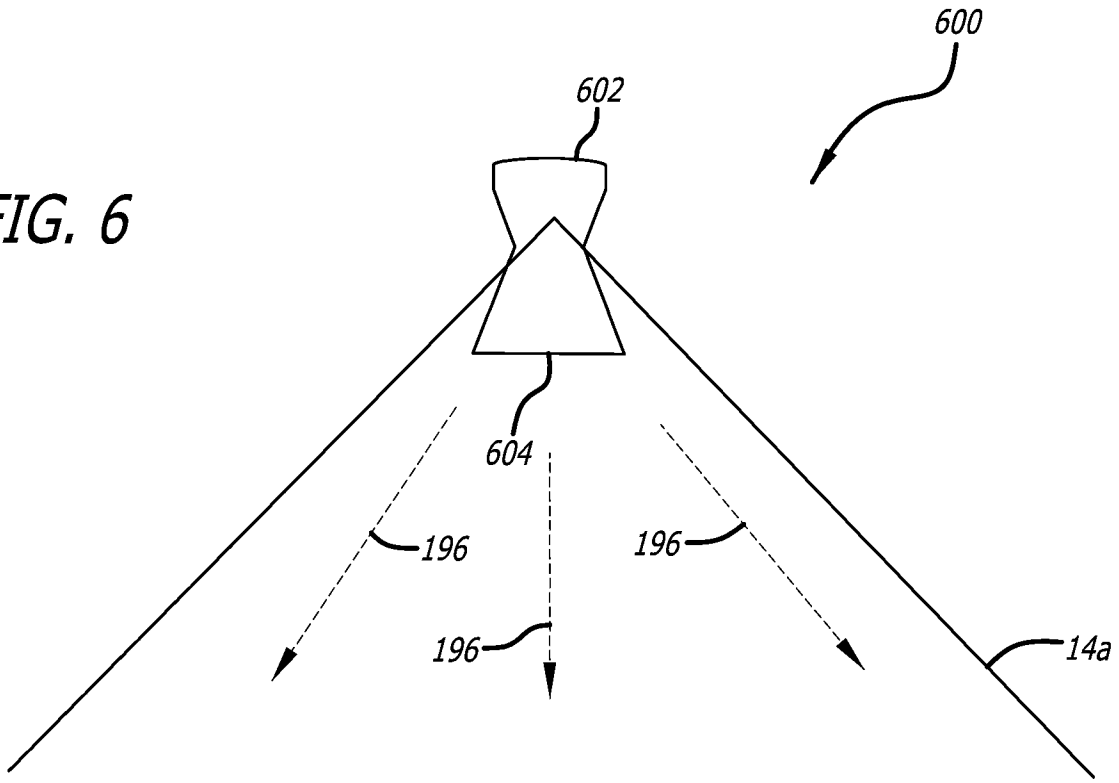
FIG. 6 illustrates a water dispensing outlet that is configured in accordance with another embodiment of the present disclosure for a method and apparatus for protecting structures against fires in high wind conditions.

FIG. 6 includes a nozzle 600 that may be used for a hipped end 14*a* of the roof 14. The nozzle 600 includes an input 602 that may be coupled to an end of the conduits 104 that end up at a hipped end of a roof, such as the hipped end 14*a* of the roof 14. The nozzle 600 also includes a flared nozzle portion 604 that dispenses water in a pattern along arrows 196. For sake of clarity and to minimize potential clutter in the figures, only a limited number of the arrows 196 are illustrated.

Figure 8:
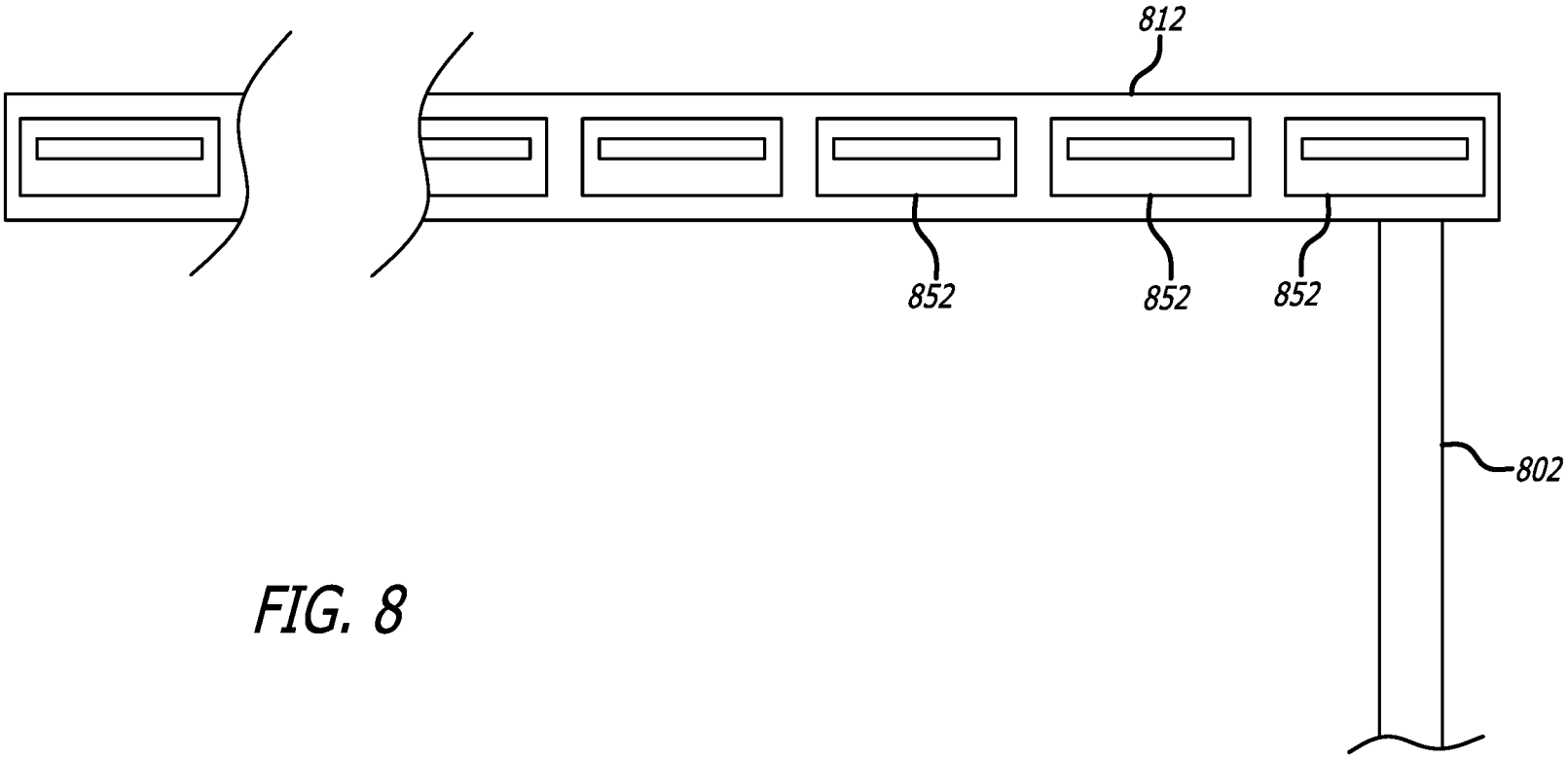
FIG. 8 illustrates a gutter that includes a plurality of openings for dispensing water to protect a side of a structure to which it is mounted.
Figure 9:
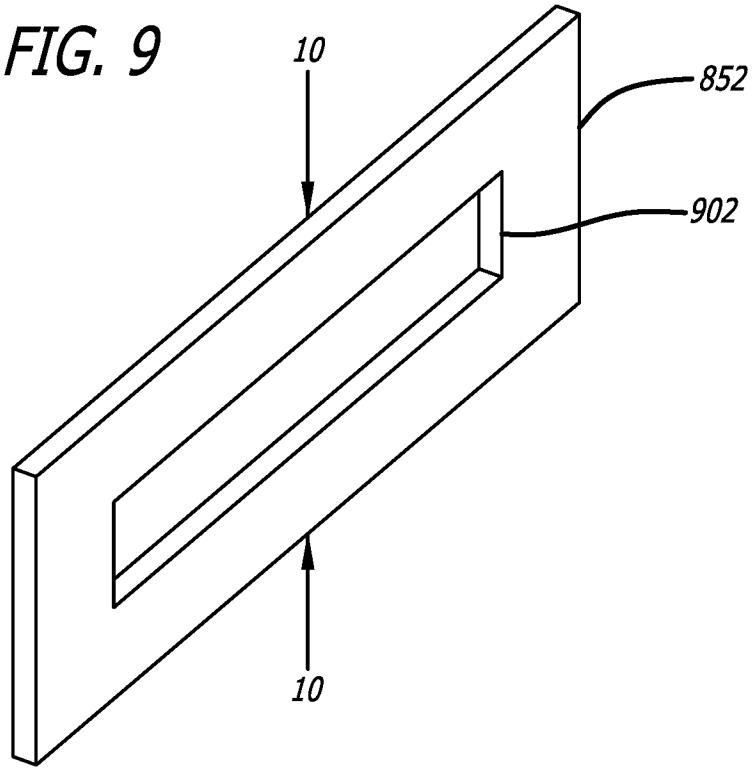
FIG. 9 illustrates a front perspective view of an insert that may be used for each of the plurality of openings for dispensing water for the gutter of FIG. 8.
Figure 10:
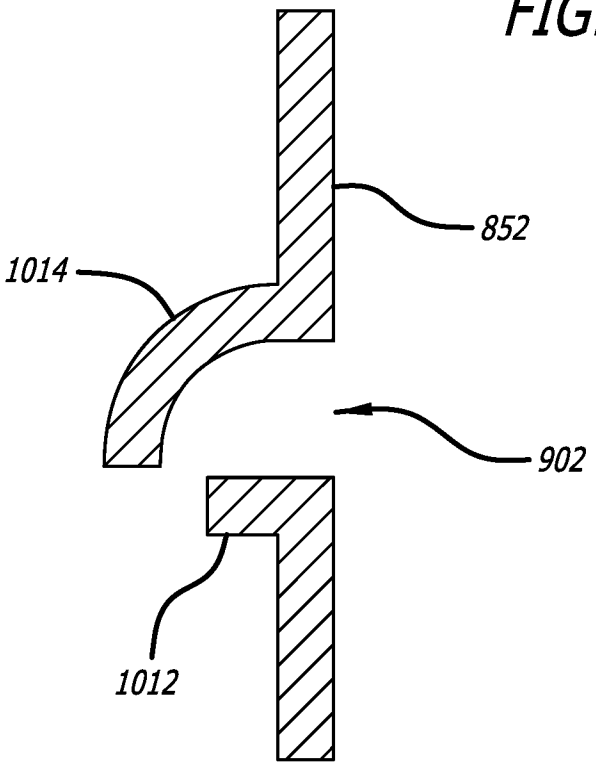
FIG. 10 illustrates a cross-section of the insert of FIG. 9 taken on line 10-10 of the same figure.

FIG. 8 illustrates a side view of a gutter 812 such as the gutter 22 of FIG. 1 that may be configured to include fire protection features in accordance with various aspects of the method and apparatus for protecting structures against fires in high wind conditions. The gutter 812 includes a plurality of openings 852, each with an insert that is detailed in FIG. 9. As shown, each insert includes an opening 902, with a cross-section shown along 10-10 in FIG. 10. Thus, also referring to FIG. 10, each insert includes a ledge 1012 and an overhang 1014. The gutter 812 also includes a gutter drain 802 through which water such as through rain may be expelled after the rainwater has been collected in the gutter 812.

Figure 11:
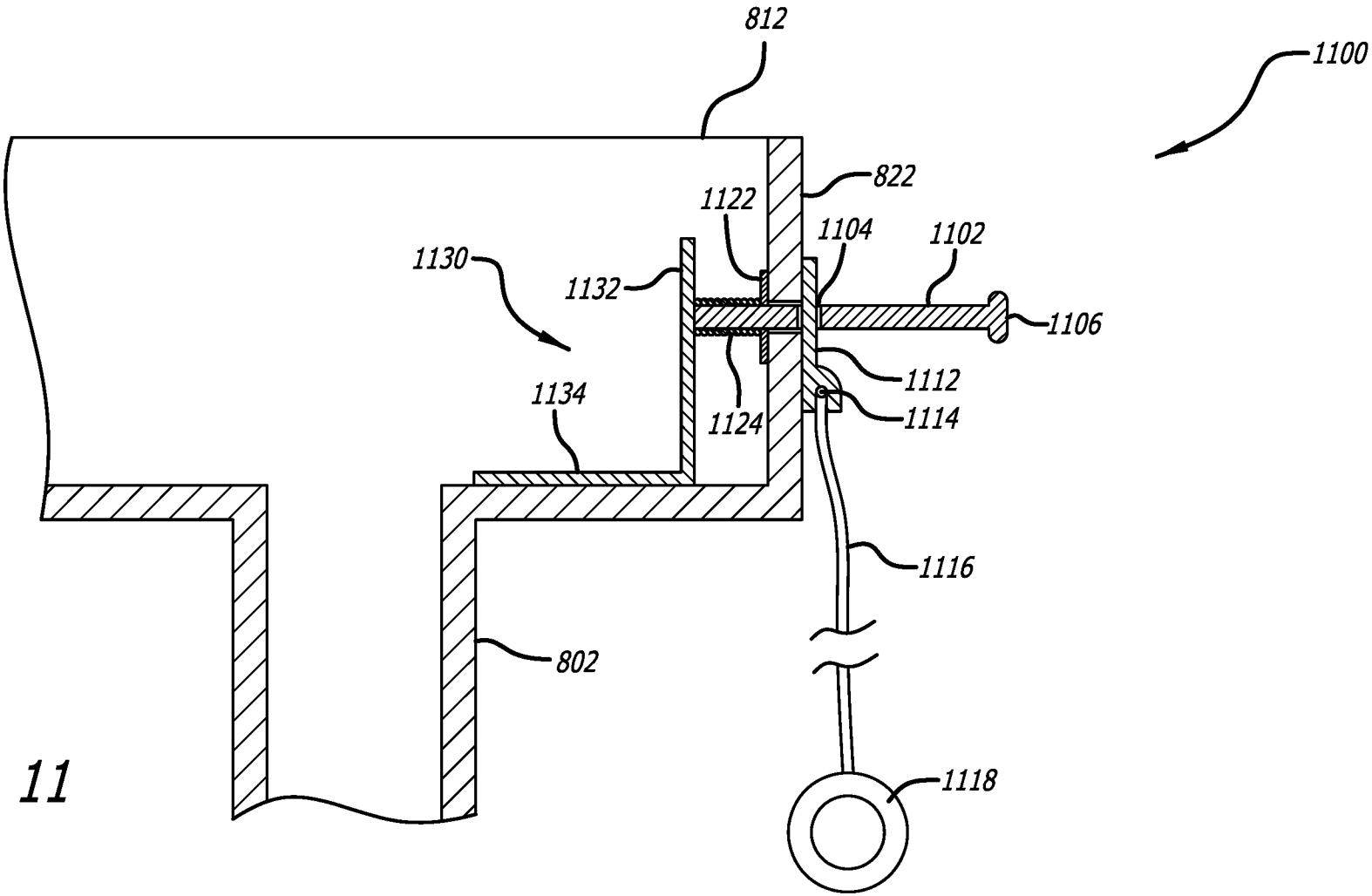
FIG. 11 illustrates a cross-section of a gutter shutoff device configured in accordance with one aspect of the disclosed invention.

FIG. 11 illustrates a cross-section of a gutter drain shutoff device 1100 configured in accordance with one aspect of the disclosed invention that may be attached to the gutter 812 of FIG. 8. In one embodiment, the gutter drain shutoff device 1100 is mounted via a shaft 1102 that passes through an opening in an end wall 1152822 of the gutter 812 to attach to an L-shaped bracket 1130 having a bracket wall 1132 and a cover portion 1134. The cover portion 1134 may be shaped to be large enough to cover the gutter drain 802.

The shaft 1102, which may be cylindrical or in any other shape, includes a stop portion 1106 on an end that is opposite to the end of the shaft 1102 attached to the L-shaped bracket 1120. The stop portion 1106 is larger than the opening in the end wall 1152822 of the gutter 812 for purposes that will be described herein. For example, the shaft 1102 may be implemented using a bolt, and secured to the L-shaped bracket 1120 by being threaded therethrough. The shaft 1102 is held in place in the gutter 812 with a pin 1112 that is inserted through a hole 1104 of the shaft 1102. The pin 1112 includes an opening 1114 through which a rope or chain 1116 may be attached. The rope 1116 may include a ring 1118 to facilitate removal of the pin 1112 from the hole 1104 of the shaft 1102.

A spring 1124 includes one end that presses against a washer 1122 that is thus forced against the end wall 1152822. The spring 1124 also includes another end that presses against the bracket wall 1132. The compression forces exerted by the spring 1124 also helps to hold the pin 1112 in place.

In one aspect of operation of the gutter drain shutoff device 1100, once the pin 1112 is removed, such as by a user pulling on the ring 1118, the spring 1124 will be allowed to force the L-shaped bracket 1130 away from the end wall 1152822 of the gutter 812. The shaft 1102 would be prevented from passing through the opening in the end wall 1152822 by the stop portion 1106 of the shaft 1102 that, as stated above, is larger than the opening in the end wall 1152822. The L-shaped bracket 11201130 would be stopped at a position such that the cover portion 1134 will block the opening of the gutter drain 802. Thus, when a fire-retardant such as water is dispensed from the conduits 104 and flows into the gutter 812, it will continue to be collected in the gutter 812 because the water will not be allowed to drain as the gutter drain 802 is blocked by the cover portion 1134 of the gutter drain shutoff device 1100. Once enough water has accumulated in the gutter 812 to reach the opening 902 of each insert in the plurality of openings 852, the water will be dispensed over the ledge 1012, as guided also by the overhang 1014.

In another embodiment, instead of a gutter drain shutoff device such as the gutter drain shutoff device 1100 of FIG. 11, a covering may be used to cover the plurality of openings 852 to allow the gutter 812 to operate as a rain gutter. Then, an actuator may move the covering to uncover the plurality of openings 852 and allow water to flow out of the plurality of openings 852 to act as a fire-retardant.

Several aspects of a fire protection system have been presented with reference to a residential structure. As those skilled in the art will readily appreciate, various aspects described throughout this disclosure may be extended to other architectures and structures, including commercial structures. Further, it should be noted that although water is mentioned as the liquid that is used in the fire protection system, other liquids, including liquids that are specifically designed to quench fire, may be used.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c). As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein but is to be accorded the full scope consistent with the language claims, wherein reference to an element in the singular is not intended to mean "one and only one" unless specifically so stated, but rather "one or more." For example, the articles "a" and "an" as used in this application and the appended claims should generally be construed to mean "one or more" unless specified otherwise or clear from the context to be directed to a singular form. Unless specifically stated otherwise, the term "some" refers to one or more. Moreover, the term "or" is intended to mean an inclusive "or" rather than an exclusive "or." That is, unless specified otherwise, or clear from the context, the phrase, for example, "X employs A or B" is intended to mean any of the natural inclusive permutations. That is, for example the phrase "X employs A or B" is satisfied by any of the following instances: X employs A; X employs B; or X employs both A and B. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

It is to be understood that the claims are not limited to the precise configuration and components illustrated above. Various modifications, changes and variations may be made in the arrangement, operation and details of the methods and apparatus described above without departing from the scope of the claims.

What is claimed is:

1. An apparatus for fire protection to a peak of a roof of a structure comprising:

a fire-retardant conduit mounted to the peak of the roof comprising:

a channel having sidewalls, each sidewall including a top portion having a lip a planar lip extending outward from each said sidewall, wherein the planar lip forms an acute angle with respect to an outer surface of each said sidewall;

a channel windbreak configured to cover the channel and the planar lip of the channel, the channel windbreak comprising a planar hanging portion extending downward from a top portion of the channel windbreak; and a fire-retardant source pipe coupling the fire-retardant conduit to a fire-retardant source to supply fire-retardant into the channel so that the fire retardant flows over the planar lip.

2. The apparatus of claim 1, wherein the sidewalls of the channel are relatively parallel to each other, and wherein the channel windbreak comprises: an overhang portion that extends beyond the planar lip of the top portion of each said sidewall of the channel.

3. The apparatus of claim 2, wherein the planar hanging portion of the channel windbreak further comprises a hanging portion that extends below an opening between a top surface of the planar lip of the channel and a bottom surface of the channel windbreak.

4. The apparatus of claim 3, wherein the opening between the top surface of the planar lip of the channel and the bottom surface of the channel windbreak is defined by a spacer resting on the top surface of the lip planar lip and supporting the bottom surface of the channel windbreak.

5. The apparatus of claim 1, further comprising a gutter structure comprising:

a gutter channel configured to capture fire-retardant, flowing down the roof, as provided from the channel, wherein the gutter channel comprises a first gutter sidewall comprising a plurality of openings configured to dispense fire-retardant onto a side of the structure.

6. The apparatus of claim 5, further comprising a second gutter sidewall configured to secure the gutter channel to an eave of the roof.

7. The apparatus of claim 5, wherein the first gutter sidewall has a longitudinal length running parallel to the eave of the roof, and the plurality of openings of the first gutter sidewall comprises:

a set of openings that are spaced along the longitudinal length.

8. The apparatus of claim 5, wherein the gutter structure further comprises a gutter drain, and the gutter structure further comprising a gutter drain shutoff device having a cover portion mounted to the gutter channel configured to: (a) allow drainage, by the gutter drain, of rainwater as collected by the gutter channel with the cover portion of the gutter drain shutoff device in a first position; and (b) block the gutter drain with the cover of the gutter drain shutoff device in a second position to prevent drainage by the gutter drain of any fire-retardant collected by the gutter channel.

9. The apparatus of claim 8, wherein the cover portion comprising an L-shaped bracket to cover the gutter drain when the gutter drain shutoff device is in the second position.

10. The apparatus of claim 9, wherein the slide of the gutter drain shutoff device further comprising a spring for moving the L-shaped bracket of the slide between the first position and the second position.

11. The apparatus of claim 1, wherein the channel of the fire-retardant conduit further comprises a first end having: (a) an inlet pipe configured to supply fire-retardant to the channel of the fire-retardant conduit; and (b) a pass-through pipe that extends the length of the channel to a second end of the channel, and wherein the fire-retardant source pipe comprises a splitter with a first output coupled to the inlet pipe, and a second output coupled to the pass-through pipe.

12. The apparatus of claim 11, further comprising a second fire-retardant conduit having a second channel, wherein the pass-through pipe exits the second end of the channel and is coupled to a second inlet pipe configured to supply fire-retardant to the second channel.

* * * * *